United States Patent [19]

Devos et al.

[11] Patent Number: 4,664,785

[45] Date of Patent: May 12, 1987

[54] PROCESS FOR DISTILLATION OF PETROLEUM BY PROGRESSIVE SEPARATIONS

[75] Inventors: André Devos, Bezons; Jean P. Gourlia, Lyons; Henri Paradowski, Cergy, all of France

[73] Assignee: Societe Nationale Elf Aquitaine, France

[21] Appl. No.: 703,496

[22] Filed: Feb. 20, 1985

[30] Foreign Application Priority Data

Feb. 24, 1984 [FR] France ..... 84 02806

[51] Int. Cl.[4] ..... C10G 7/00

[52] U.S. Cl. ..... 208/354; 208/353

[58] Field of Search ..... 208/354, 355, 357, 366, 208/353; 196/106; 202/154–156, 172, 173; 203/71, 74, 80, 81

[56] References Cited

U.S. PATENT DOCUMENTS

| | | | |
|---|---|---|---|
| 1,735,558 | 11/1929 | Youker | 208/354 |
| 1,744,599 | 1/1930 | Watson | 196/106 X |
| 1,780,286 | 11/1930 | Watson | 196/106 X |
| 1,954,839 | 4/1934 | Youker | 208/354 |
| 1,997,675 | 4/1935 | Bahlke et al. | 208/353 |
| 2,904,510 | 9/1959 | Service, Jr. | 208/366 |
| 3,320,158 | 5/1967 | Potts | 208/354 |
| 3,567,628 | 3/1971 | Van Pool | 208/354 X |
| 3,699,008 | 10/1972 | Brendt et al. | 202/155 X |
| 4,082,653 | 4/1978 | DeGraff | 208/354 X |

OTHER PUBLICATIONS

"The Heat Exchanger Network Simulator", Chemical Eng. Progress, Mar. 1979, pp. 72–77.

*Primary Examiner*—Glenn Caldarola

*Attorney, Agent, or Firm*—Ostrolenk, Faber, Gerb & Soffen

[57] ABSTRACT

The process consists in successively separating increasingly heavy petroleum cuts at the head of a plurality of columns CO1, CO2, CO3 and Cl0 of a first series of columns which feed individually each column of the second series. The column CO7 is a gasoline stabilizing column which feeds an installation for fractionating light petroleum gases. The column CO4 is a gasoline fractionating column. The columns CO5 and CO6 are columns for separating petroleum naphthas from kerosine. The atmospheric residue collected at the bottom of the column Cl0 is processed in the vacuum distillation column Cl2 and the residue from this column is processed in the second vacuum distillation column Cl3 after reheating in a furnace.

By carrying out a succession of progressive separations performed in a series of columns of small volume, more efficient utilization of the recovery heat is achieved.

15 Claims, 10 Drawing Figures

C13
C12
C11
C10
B11
B10
GO N°2
GO N°1
CO6
CO3
OSV
RSV
GOSV
EAU
F31
F32
F12
F33
F46
F30
F29
F27
F26
F28
F20
F19
F22
F21
F17
F14
F16
F13
F24
F15
E16
E02
E09
E21
E25
E17
E47
E35
E29
E39
E41
E38
E40
E37
E32
E42
E30
E08
E55
E18
E03
E06
E20
E23
E26
E34
E60
E19
E17
E14
E07
E59
E36
E33
E31
P30
P29
P28
P27
P26
P25
P24
P23
P22
P21
P20
P19
P18
P17

PROCESS FOR DISTILLATION OF PETROLEUM BY PROGRESSIVE SEPARATIONS

BACKGROUND OF THE INVENTION

1. Field of the Invention

This invention relates to a process for distillation of petroleum of fossil or synthetic origin by progressive separations, in which the feed preheated by heat exchange is prefractionated in successive steps in at least one column which operates at a pressure within the range of 1 to 5 atm. abs., as well as to an installation for the application of the process.

2. Description of the Prior Art

Processes are already known which utilize recovery heat for saving power and which carry out a preliminary and variable degree of separation of light fractions such as the light petroleum gases, the gasolines and kerosine prior to atmospheric distillation. However, the feed residue of these columns is necessarily reheated in one or a number of fuel furnaces prior to distillation within these columns.

SUMMARY OF THE INVENTION

The aim of the process in accordance with the present invention is to make improvements in the methods mentioned in the foregoing by carrying out a more progressive separation of petroleum fractions before and after atmospheric distillation in order to permit more effective utilization of heating by means of the recovery heat.

The basic concept of the invention lies in the discovery that, by carrying out a succession of progressive separations within a series of columns of relatively small volume, better utilization of the recovery heat is achieved by virtue of measured and judiciously distributed additions of heat.

Furthermore, progressive separations carried out under increasingly severe conditions of pressure and temperature permit the advantageous possibility of reducing the volume of effluent which, after reheating with a final addition of external heat and especially by means of a furnace, will be processed in a vacuum distillation column. The low power consumption thus achieved will be essentially due to effective utilization of recovery heat for carrying out successive separations and to the reduction in volume of effluent which is subjected to heating by an external heat source.

The process in accordance with the invention essentially consists in successively separating increasingly heavy petroleum cuts at the head of a plurality of columns of a first series of distillation columns each fed with a residue from the previous column and in collecting at the bottom of the last column of said series a so-called atmospheric residue which is then processed in a vacuum distillation zone in which provision is made for reheating of the feed in a furnace.

In a variant of the process, the atmospheric residue collected at the bottom of the last column of the first series is reheated in a furnace, then processed in a vacuum distillation column.

In another variant of the process, said residue is fed without any external addition of heat to a first vacuum distillation column, the residue of which is processed in a second vacuum distillation column after reheating in a furnace.

In accordance with a distinctive feature of the invention, each cut collected at the head of each column of the first series is fed individually to one column of a second series of columns, the distillates of which are standard petroleum products.

The process in accordance with the invention permits high operational flexibility according to established production criteria. Thus, instead of an arrangement such that one column of the second series corresponds to each column of the first series, a feasible practice now consists in feeding at least one column of the second series with volatile effluents from the two columns of the first series. A rearrangement of two columns of the second series will thus be achieved, for example either by mounting them one above the other so as to form a single column for fractionating gasolines with side-stream withdrawal or by regrouping the two columns which are placed downstream of the gasoline fractionating column and produce petroleum naphtha and kerosine.

It is also possible to add a supplementary column in each series of columns. Thus, should it be desired to enhance the production of intermediate gasoline, the gasoline fractionating column can be split into a second and third column of the second series. The residue of the second column consisting of intermediate gasoline is removed as a standard petroleum product or fed to the third column which is also fed with a cut collected at the head of a third column of the first series for separating the intermediate gasoline from the petroleum naphtha.

A supplementary column can be added as a function of other production criteria. For example, in the case of a requirement such as the production of a solvent between petroleum naphtha and kerosine, it would be possible to interpose a supplementary column which is located before the last column of the first series and feeds a supplementary column placed before the last column of the second series.

Similarly, the flexibility of the process results in the possibility of varying the feed circuit for the columns of the second series.

In accordance with one of the distinctive features of the process contemplated by the invention, a first column of the second series is a column for stabilization of gasolines, the volatile effluent of which is fed to a plant for fractionating light petroleum gases and the residue of which is combined with the emergent gasoline cut from the second column of the first series in order to feed a second column of the second series.

In accordance with another distinctive feature, a second column of the second series is a column for fractionating gasolines, the residue of which consists of a petroleum naphtha which is combined with the volatile fraction of a third column of the second series.

In accordance with yet another distinctive feature, the residue of the gasoline fractionating column feeds the next column of the same series.

In regard to addition of heat, the initial feed, the residues which flow between the columns of the first series and the effluents which flow between the columns of the second series are preferably preheated by transfer of sensible and latent heat released by other effluents without addition of heat by means such as a furnace.

Similarly, the addition of heat for reboiling of columns is advantageously carried out by heat transfer of the same nature. In particular, the addition of sensible heat takes partially place by heat exchange with a fraction of the residue issuing from the last vacuum distillation column and recycled to the feed inlet of the furnace.

In order to enhance the flexibility of the process even further and in order to introduce an addition of heat in the stream being processed, a judicious procedure which has become apparent and constitutes another distinctive feature of the invention consists in continuously recycling a fraction of the exit residue from the last vacuum distillation column into the feed stream of one or more of the atmospheric columns of the first series or of the first vacuum distillation column.

The invention is further directed to an installation for carrying out the process outlined in the foregoing. This installation is distinguished by the fact that the head outlets of four columns of the first series of columns are connected individually to the four columns of the second series of columns. The first of these four columns is a gasoline stabilization column, a head outlet of which is connected to an installation for fractionating light petroleum gases and a bottom outlet of which is connected to a second column which is a gasoline fractionating column, the head and bottom outlets of which are connected to gasoline storage tanks. The third column has the function of separating petroleum naphtha from kerosine and is connected to storage tanks. The fourth column is fed with the top fraction of the so-called atmospheric column which is the last of the first series of columns and is also connected to the storage tanks. Finally, the atmospheric column just mentioned, or last column of the first series, is a reflux column connected to a stripper which is in turn connected to a storage tank for so-called atmospheric gas-oil. Said atmospheric column is provided with a bottom outlet for the so-called atmospheric residue which is connected via a fuel-heated furnace to the feed inlet of a vacuum distillation column connected to storage tanks.

In an alternative embodiment, the so-called atmospheric column is connected via a bottom outlet to a first vacuum distillation column provided with sidestream withdrawal means and with a bottom outlet connected via the furnace to a second vacuum distillation column. Both vacuum distillation columns are connected via sidestream withdrawal means to tanks for storage of gas oil and distillates.

In another embodiment, a supplementary column is interposed between the second and the third column of the first series and its head outlet feeds a supplementary column which is interposed between the second and the third column of the second series and which may if necessary be fed by the bottom outlet of the second column of the second series. The head outlet of said supplementary column of the second series is connected to a tank for storage of intermediate gasoline.

In a further embodiment, a supplementary column is interposed between the third and the fourth column of the first series and its head outlet feeds a supplementary column which is interposed between the third and the fourth column of the second series and the head outlet of which is connected to a tank for storage of a solvent having a boiling point between that of petroleum naphtha and kerosine.

In again another embodiment, the second and the third column of the second series are columns superposed within a single gasoline fractionating tower, the bottom outlet of which feeds a fourth column of the second series, each column being connected to respective storage tanks.

In an alternative embodiment, the third and fourth columns of the second series are combined in a single column, the feed inlets of which are connected to the head outlets of the third and fourth columns of the first series.

In another embodiment, the inlet of the third column of the second series, which is a column for the separation of petroleum naphtha from kerosine, is connected to the bottom outlet of the preceding column in the same series and to the outlet of the third column of the first series.

BRIEF DESCRIPTION OF THE DRAWINGS

Other features of the invention will be more apparent to those skilled in the art upon consideration of the following description and accompanying drawings, wherein.

DESCRIPTION OF THE PREFERRED EMBODIMENTS

Figure 1:
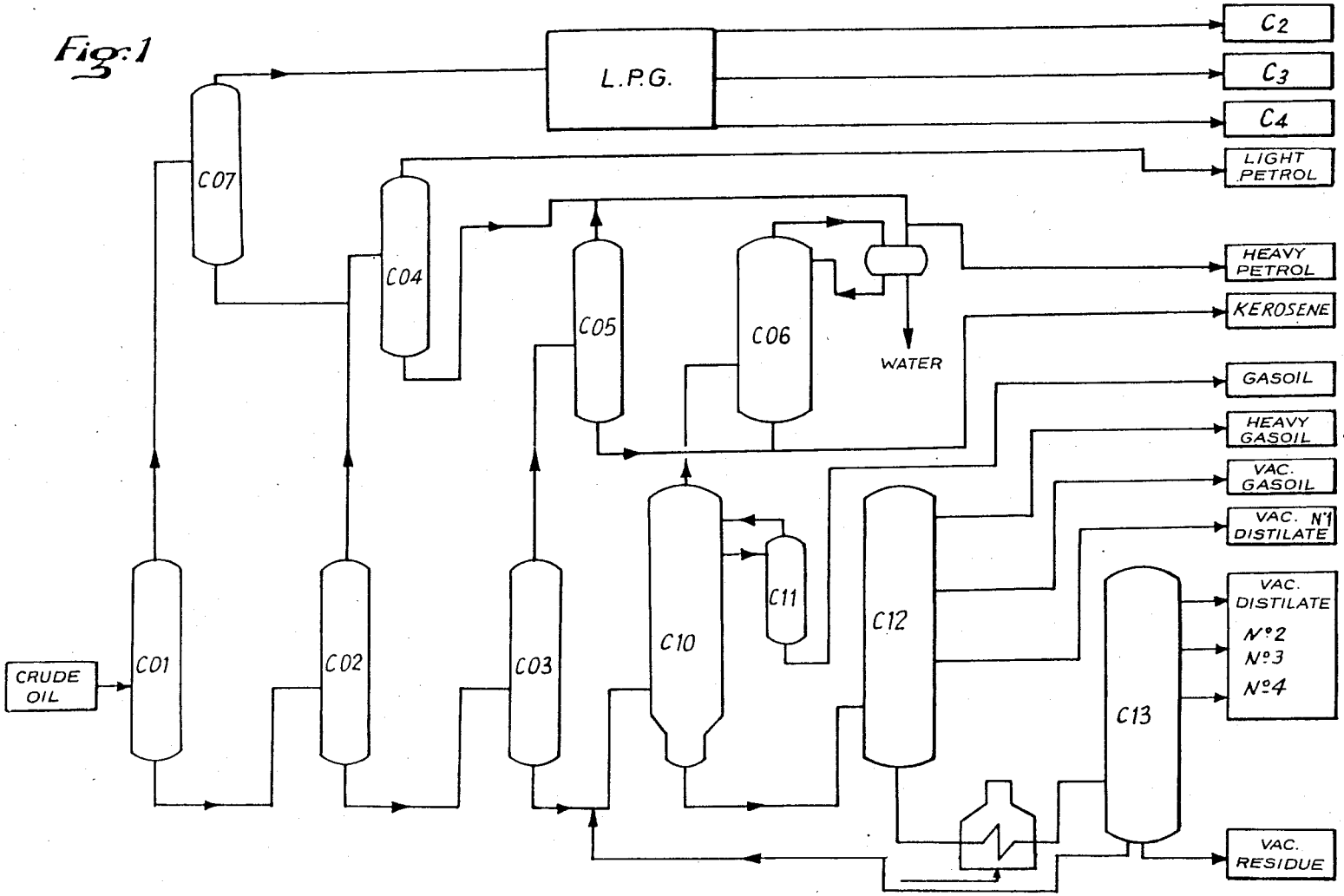
FIG. 1 is a general flow diagram in accordance with a particular embodiment.

The installation comprises two series of columns. The first series is composed of distillation columns which operate at atmospheric pressure or at a pressure higher than atmospheric and are designated by the references C01, C02, C03 and C10 provided with a stripper C11. These columns are each fed with a residue from the preceding column and their top fractions feed individually each one of the columns of the second series of distillation columns C07, C04, C05 and C06. The base of the last column C10, or so-called atmospheric column, feeds with atmospheric residue a first vacuum distillation column C12. The residue from this first column is preheated in a single fuel furnace and introduced into a second vacuum distillation column C13.

The columns of the first series are plate-type distillation columns for the separation of top fractions and bottom fractions. In regard to temperature and pressure values, the operating conditions of these plate columns are predetermined with a view to ensuring that the volatile fractions released become progressively heavier. Thus, preheating of the residues fed to the columns and carried out by exchange of sensible and latent heat with other effluents has the effect of heating said residues to increasing temperatures in the order in which the columns are placed. The volatile fraction of column C01 composed of all the light petroleum gases and part of the gasolines is fed to column C07 of the second series which is a column for stabilization of gasolines, the volatile fraction of which feeds a plant for fractionating light petroleum gases. The volatile fraction of column C02 is combined with the residue of column C07 and feeds gasoline alone to column C04 which is a gasoline fractionating column, the head effluent of which is a light gasoline and the residue of which is a petroleum naphtha.

The volatile fraction of column C03 composed of a remaining quantity of kerosine is fed to column C05 which extracts petroleum naphtha from this latter as a volatile fraction and kerosine as a residue. The last column C10 of the first series is a reflux atmospheric column, the bottom of which is stripped with steam. A stripper C11 is connected to the top section of the column. The volatile fraction of column C10 feeds column C06 and an effluent containing gasoline, kerosine and water. The residue of column C06 is kerosine which combines with the residue of column C05 for subsequent storage. After separation of water, the volatile fraction constitutes the remainder of the petroleum naphtha which is transferred to storage.

The stripper C11 of column C10 serves to remove volatile fractions from the light atmospheric gas-oil prior to transfer to storage. The atmospheric residue which is steam-stripped at the bottom of column C10 is introduced into a first vacuum distillation column C12 in which three volatile fractions are separated by expansion and are withdrawn as sidestreams at different column levels: heavy gas-oil, vacuum gas-oil and a vacuum distillate as well as a residue. The residue from column C12 is heated in a fuel furnace, then introduced into a second vacuum distillation column C13 which separates a number of vacuum distillate cuts as well as a vacuum residue.

In the example of application which now follows with reference to the detail diagram shown in FIGS. 7 to 10, a feedstock of Arabian crude oil is processed in a plant of the type described earlier.

A charge of 771.6 t/h at 15° C. (stream F1) is pumped from storage by means of the pump P01 and preheated under pressure at 140° C. by heat transfer by means of the following heat-exchangers : E01 (condenser of column C04), E02 (circulating reflux F28 of the vacuum distillate), E03 (circulating reflux F20 of atmospheric gas-oil), E04 (condenser of column C01), E05 (condenser of column C06), E06 (circulating reflux of atmospheric gas-oil), E07 (atmospheric gas-oil F14), E08 (gas-oil F22 under vacuum), E09 (circulating reflux of vacuum distillate), E10 (condenser of column C05), E11 (distillate F16 of column C10), E12 (kerosine F45), E13 (distillate F16 of column C10) and E14 (atmospheric gas-oil}. The crude is desalted in a two-stage desalting unit B08, B09, then heated under pressure at 157° C. (F2) in the heat-exchangers E15 (low-pressure steam), E16 (vacuum distillates F32) and E17 (atmospheric gas-oil) and is fed to the column C01 at 2 bar abs.

The exit steam flow F3 from column C01 is partially condensed at 94° C. within the heat-exchanger E04.

The reflux is pumped from the reflux drum B01 by means of the pump P04 and returned to the head of column C01.

The steam distillate stream F4 composed of light petroleum gases and gasoline and flowing out of the reflux drum is passed to a so-called stabilizing column C07 which will be described hereinafter.

The stream F5 from the bottom of column C01 is recirculated by the pump P03 and reheated to 196° C. by means of the following heat-exchangers : E18 (vacuum distillate F23) E19 (condenser of column C10), E20 (circulating reflux F19 of gas-oil under vacuum), E21 (circulating reflux F27 of vacuum distillate), E22 (distillate F10 of column C03), E23 (circulating reflux of gas-oil under vacuum), E24 (circulating reflux F18 of vacuum distillate). The generated steam F6 is separated from the liquid in the drum B07, then returns into column C01. The liquid F7 is recirculated by the pump P05, then heated under pressure to 247° C. by means of the following heat-exchangers E25 (circulating reflux F27 of vacuum distillate), E26 (circulating reflux of gas-oil under vacuum), E27 (circulating reflux of vacuum distillate), E28 (condenser of column C03), E29 (vacuum distillate F29), E30 (vacuum residue F33), E31 (circulating reflux F13 with atmospheric gas-oil), E32 (vacuum residue), E33 (circulating reflux with atmospheric gas-oil), E34 (circulating reflux F17 for feeding column C12), E35 (circulating reflux of vacuum distillate) and E36 (circulating reflux with atmospheric gas-oil). This stream is fed to column C02 at 1.95 bars abs. This column produces a stream F8 of steam distillate at 141° C. consisting of a gasoline cut. The reflux from column C02 takes place via the heat-exchanger E52 (very-low-pressure steam generator), the drum B02 and the pump P07.

The stream F9 from the bottom of column C02 is recirculated by the pump P06, then heated under pressure to 296° C. by means of the following heat-exchangers: E37 (vacuum residue), E38 (vacuum residue), E39 (circulating reflux F26 and vacuum distillate), E40 (vacuum residue) and E41 (circulating reflux F25 of column C13). The stream which has thus been heated is fed to column C03 at 2.5 bar abs. This column produces a steam distillate F10 at 222° C., this distillate being composed of petroleum naphtha and kerosine. The reflux from said column C03 takes place via the heat-exchanger E28, the drum B03 and the pump P09. The stream F11 from the bottom of the column is recirculated by the pump P08, heated to 320° C. within the heat-exchanger E42 (vacuum residue), then mixed with 100 t/h of vacuum residue F12 at 380° C. in order to feed column C1O at 2.3 bar abs. The bottom of said column is stripped with 7.5 t/h of low-pressure steam. This column is provided with a circulating reflux with withdrawal of gas-oil F13 in order to condense the internal reflux which is necessary for good performance of the column. A side stripper C11 makes it possible to obtain 59 t/h of atmospheric gas-oil F14 consisting of a cut of petroleum naphtha, of kerosine and of steam. The heat-exchanger E19, the drum B10 and the pump P09 effect the reflux of the column. This reflux produces fractionation between the kerosine and gas-oil cuts.

The gas-oil thus produced is cooled to 45° C. within the heat-exchangers E17, E14, E07 and E59 (coolant water).

The residue F15 of the column or so-called atmospheric residue is fed to column C12 at 0.1 bar abs. The bottom of this column is stripped with 8 t/h of very-low-pressure steam. The column is provided with four circulating refluxes effected respectively by the following equipment units, starting from the base of the column:

pump P21 and heat-exchanger E34 : feed circulating-reflux F17 pump P22 and heat-exchanger E24 : circulating reflux F18 of vacuum distillate pump P23 and heat-exchangers E26, E 23, E20 : circulating reflux of gas-oil under vacuum F19 pump P24 and heat-exchangers E06, E03 : circulating reflux of atmospheric gas-oil F20.

This column produces 80 t/h of atmospheric gas-oil F21 which is cooled to 45° C. by the heat-exchanger E60 (coolant water), 38 t/h of gas-oil under vacuum F22 which is cooled to 45° C. within the heat-exchangers E08, E55 (air preheater of the furnace) and 24 t/h of vacuum distillate F23, the available heat of which is recovered up to 160° C. within the heat-exchanger E18.

The vacuum of the column is produced by a precondenser and a group of ejector condensers which is common with the column C13. The process water is recirculated by the pump P25 from the drum B11 to a water-treatment plant.

The residue of said column F24 which is recirculated by the pump P20 is heated to 400° C. within a furnace F01 and diluted with 13 t/h of low-pressure steam and is then fed to column C13 which operates at 0.1 bar abs.

The column C13 is provided with four circulating refluxes which are effected respectively by the following equipment units starting from the base of the column :

pump P27 and heat-exchanger E41 : feed circulating-reflux F25 pump P28 and heat-exchanger E39 : circulating reflux F26 of vacuum distillate pump P29 and heat-exchangers E35, E47 (reboiler of column C06), E25, E27, E21 (circulating reflux F27 of vacuum distillate)

pump P30 and heat-exchangers E09 and E02 : circulating reflux F28 of vacuum distillate.

The column C13 produces three cuts of vacuum distillate respectively, starting from the base of the column : vacuum distillate No 4, F29 ; No 3, F30 ; No 2, F31, namely a total stream flow F32 of 152 t/h.

Recovery of heat up to 160° C. contained in these streams takes place within the heat-exchanger E16, vacuum distillate No 4 having previously been cooled within the heat-exchanger E29. The bottom of the column is stripped with 9 t/h of very-low-pressure steam. The vacuum residue produced at the bottom of the tower is recirculated by the pump P26 and part of this residue under hot vacuum is recycled upstream of the column C10. The vacuum residue is successively cooled to 230° C. within the heat-exchangers E42, E40, E38, E46 (reheating of column C05), E37, E32 and E30. After the heat-exchanger E42, part of this residue is recycled to the bottom of the tower in order to adjust the temperature of the stream F34.

A vacuum is produced within said column by means of a precondenser and an ejector-condenser system which is common with column C12.

The steam distillate (F4) which passes out of the column C01 is cooled to 40° C. within the heat-exchanger E61 (coolant water). The liquid and vapor phases thus obtained are separated within the drum B12. The vapor phase F35 is heated to 60° C. within the heat-exchanger E50 (petroleum naphtha) before being compressed to 4 bar abs. by means of the compressor K01 in order to feed column C07. The liquid phase is recirculated by the pump P31, heated to 80° C. within the heat-exchanger E51 (petroleum naphtha) before being fed to the column C07 (stream F36).

The column C07 is reboiled by means of the heatexchangers E43 (kerosine) and E44 (low-pressure steam). Top-of-column condensation is produced by a cooling cycle composed of the drum B13, heat-exchangers E62 (coolant water), compressors K03 and the condenser E53. Condensation of part of the top-of-column stream takes place within the drum B14. The pump P32 effects the reflux of column C07. A flow rate of 15 t/h of light petroleum gases is accordingly produced. The residue F37 from column C07 is fed directly to column C04 by expansion at 1.7 bar abs. This column is also fed with the steam distillate F8 from column C02.

Reboiling of column C04 is carried out by the heat-exchanger E45. The steam flow from the top of the column is entirely condensed within the heat-exchanger E01, then collected within the drum B04. The pump P04 effects the reflux and transport of the 37 t/h of light gasoline F38 produced at the top of the column. This gasoline is cooled to 40° C. within the heat-exchanger E56 (coolant water). The residue F39 obtained at the bottom of the column and recirculated by the pump P10 consists of 40 t/h of a petroleum naphtha cut which, after having been mixed with the petroleum naphtha produced at the head of the columns C05, F40, and C06, F41, is cooled to 40° C. within the heat-exchangers E51, E50, E57 (coolant water).

The distillate F10 which passes out of column C03 and is cooled to 195° C. and 2 bar abs. within the heat-exchanger E22 is fed to column C05 which produces a liquid distillate of 23 t/h of petroleum naphtha F40 and a kerosine residue F42 of 10 t/h.

Reboiling of column C05 is carried out by the heat-exchanger E46. Condensation of the reflux and of the distillate takes place within the heat-exchanger E10 and the drum B05. The pump P05 effects the reflux at the top of the column and transfers the petroleum naphtha. The kerosine produced at the bottom is recirculated by the pump P12 and cooled to 40° C., after mixing with the 45 t/h of kerosine F43 produced at the bottom of the column C06, within the following heat-exchangers : E43, E12, E48 and E49 (addition of heat to the light gas treatment section), E58 (coolant water).

The steam distillate F16 which passes out of column C10 is cooled to 125° C. and 1.7 bar abs. within the heat-exchangers E13, E11 and is fed to column C06. This column produces at the top a liquid distillate of 13 t/h of a petroleum naphtha cut F44 and produces at the bottom 48 t/h of kerosine F43. Total condensation of the flow from the top of the column takes place within the heat-exchanger E05. The drum B06 serves to separate the hydrocarbon and water phases. The pump P15 effects the reflux and transfer of the petroleum naphtha. The process water is passed by the pump P16 to the water treatment. Reboiling of column C06 is carried out by means of the heat-exchanger E47. The pump P14 serves to transfer the kerosine produced within the column.

The process and installation in accordance with the invention can be adapted to a wide range of variants, a few of which are illustrated in the diagrams of FIGS. 2 to 6.

Figure 2:
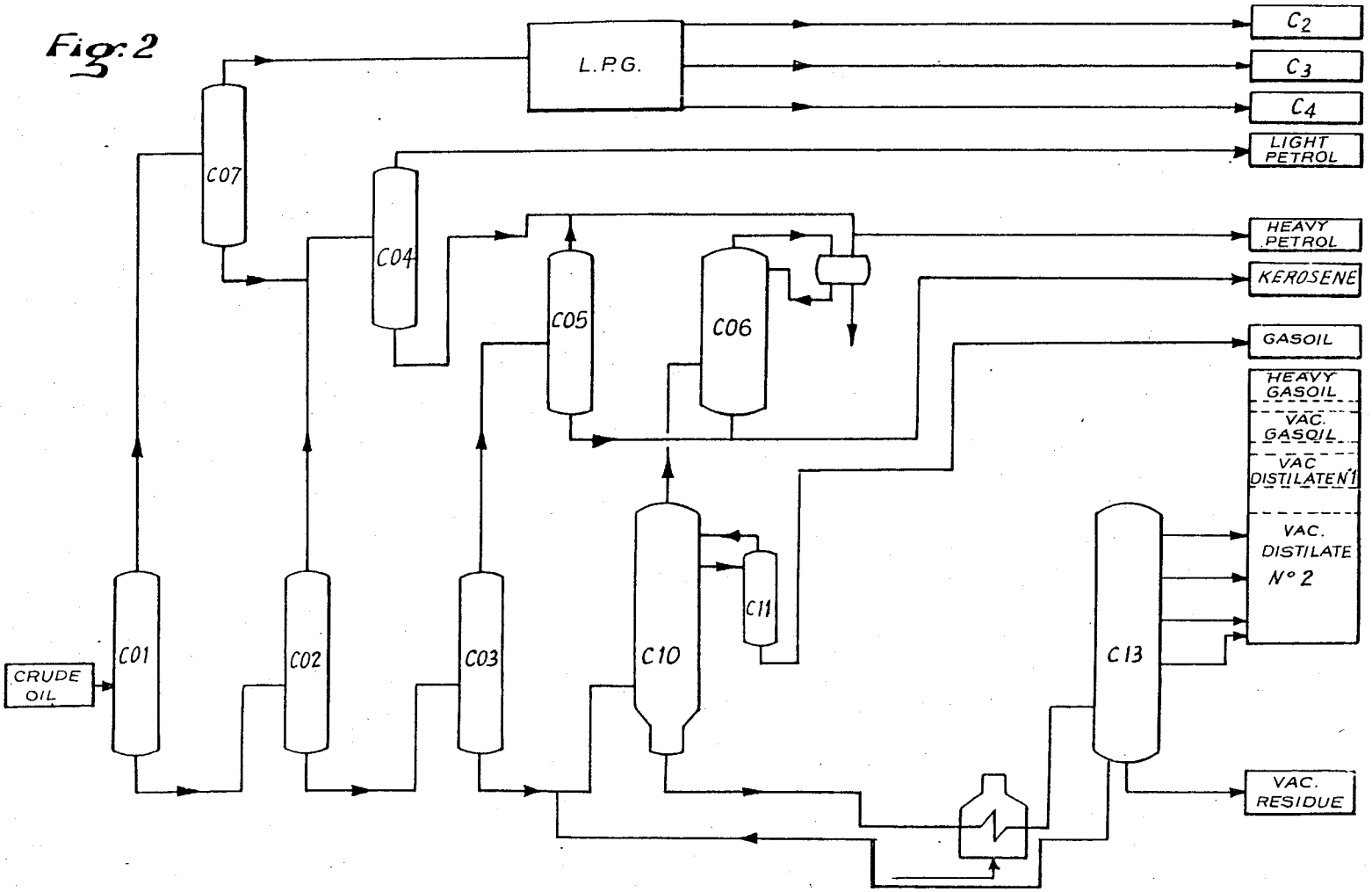
FIGS. 2, 3, 4, 5 and 6 are general diagrams showing a number of alternative embodiments.

It is thus possible to dispense with the first vacuum distillation column C12 (as shown in FIG. 2) and to pass the atmospheric residue from the atmospheric column C10 through the furnace into the second vacuum distillation column C13, the effluents of which contain both the heavy gas-oils and the vacuum gas-oils as well as the distillates.

Figure 3:
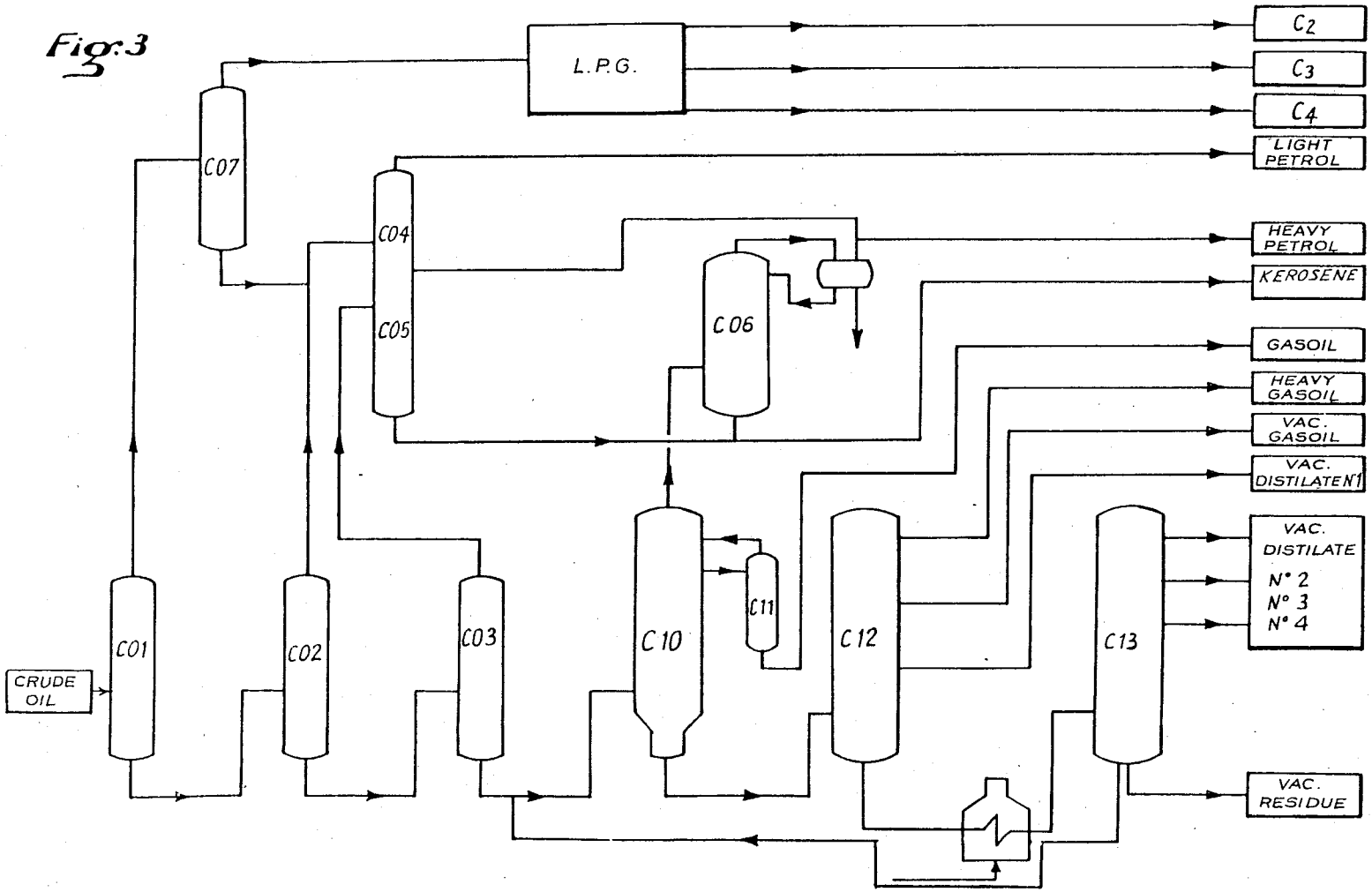

In accordance with another variant shown in FIG. 3, columns C04 and C05 are combined into a single tower for fractionating gasolines and kerosine with sidestream withdrawl, said tower being fed with the effluents from columns C02 and C03 of the first series of columns.

Figure 4:
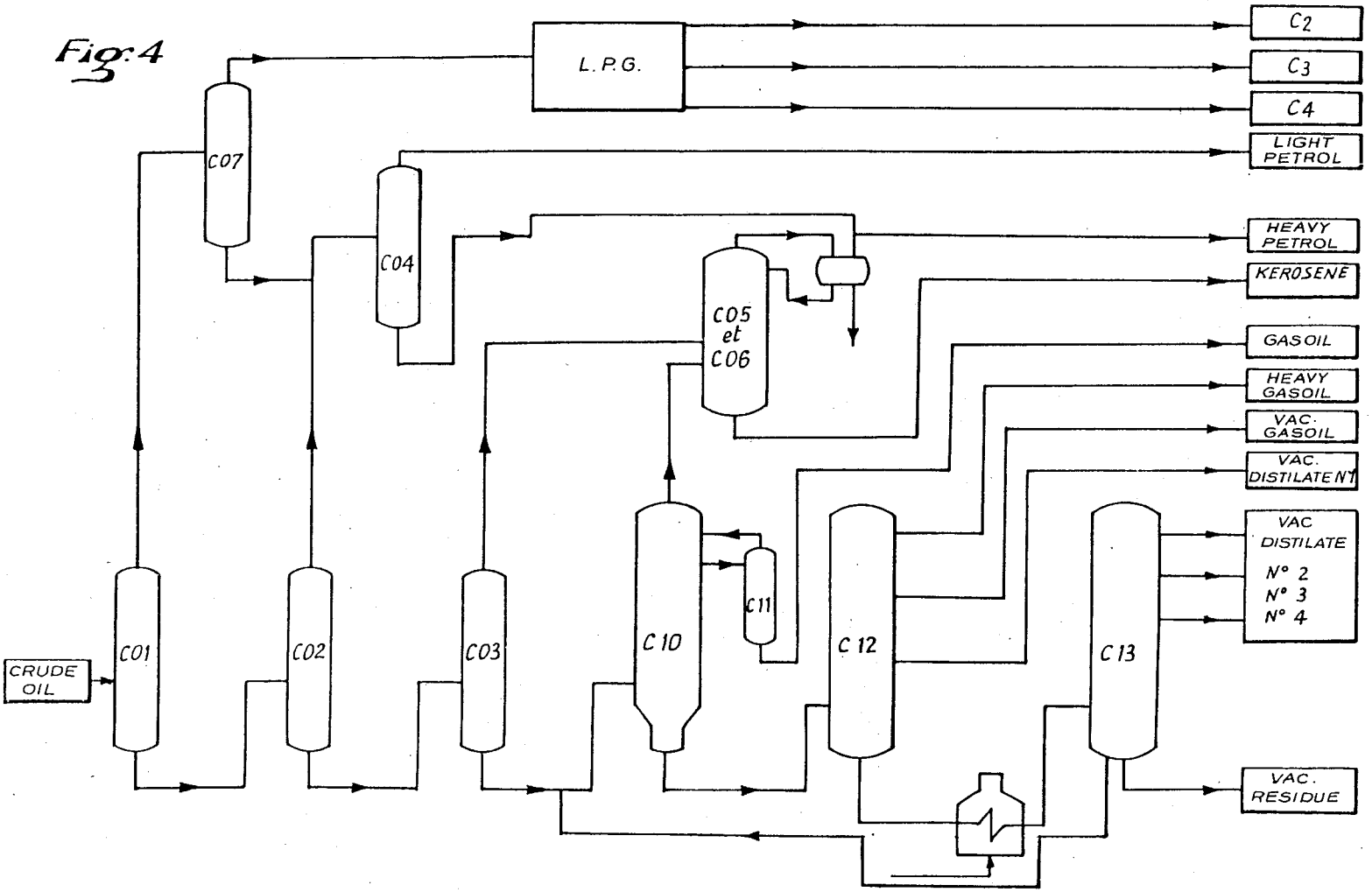

In yet another variant shown in FIG. 4, the last two columns C05 and C06 of the second series have been combined into a single column supplied with the volatile effluents from columns C03 and C10.

Figure 5:
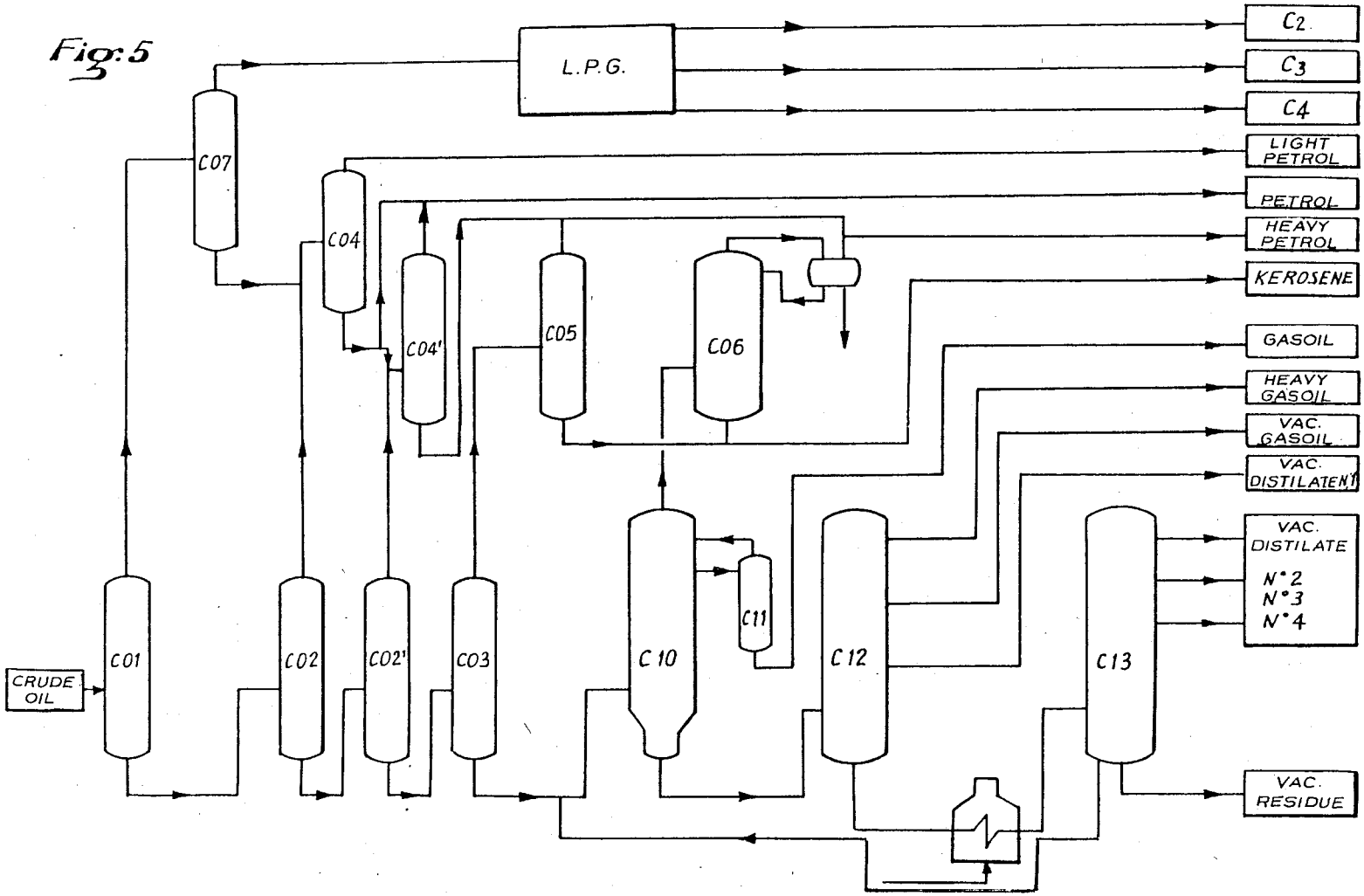

In a further varient shown in FIG. 5, a supplimentary column C04' and a supplimentary column C02' have been interposed respectively in the second and the first series of columns. This diagram is particularly applicable when it is desired to enhance the production of intermediate gasoline.

Column C04' is fed with the residue from column C04 and with the volatile effluents from column C02'.

Figure 6:
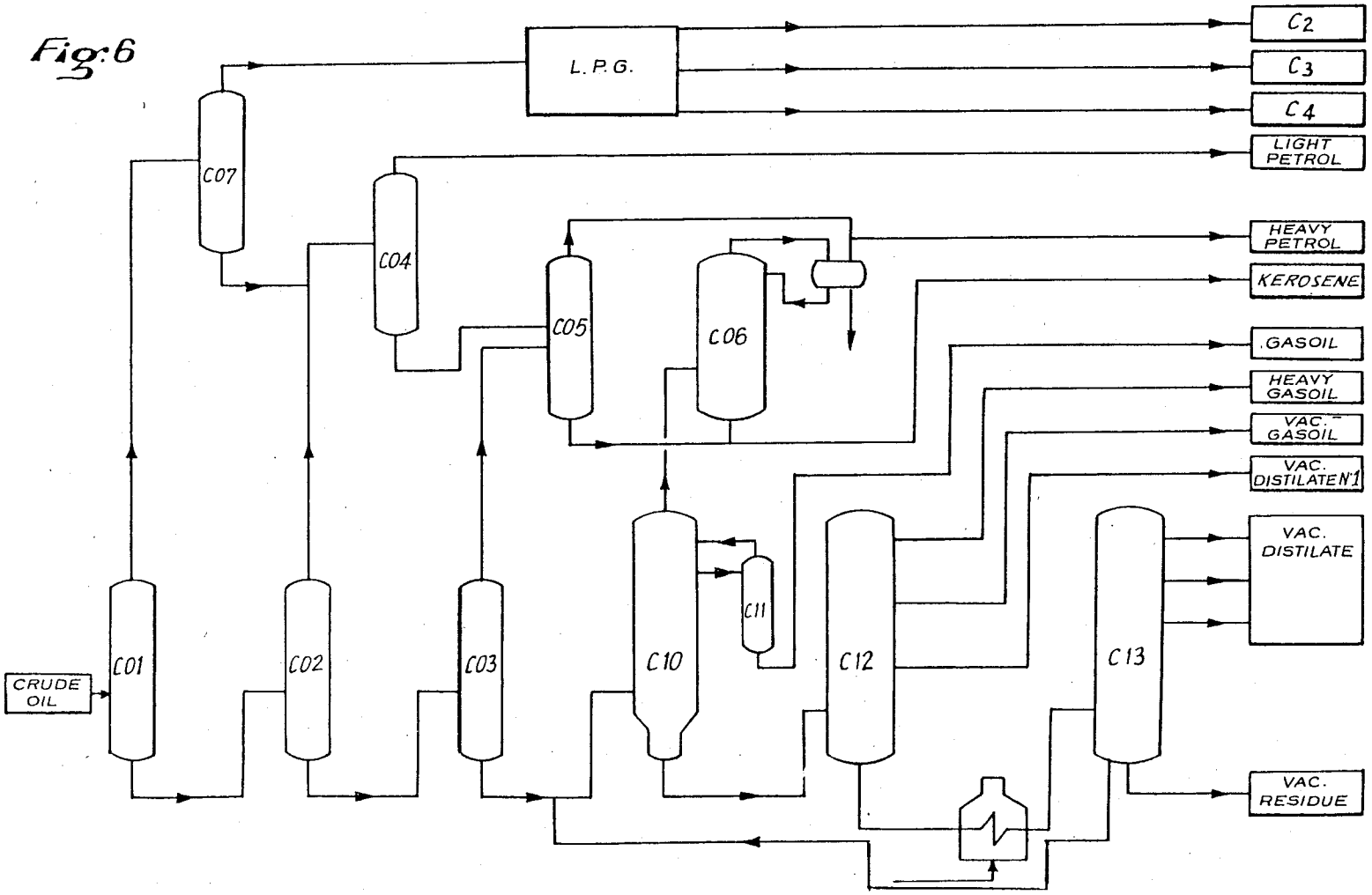
Figure 7:
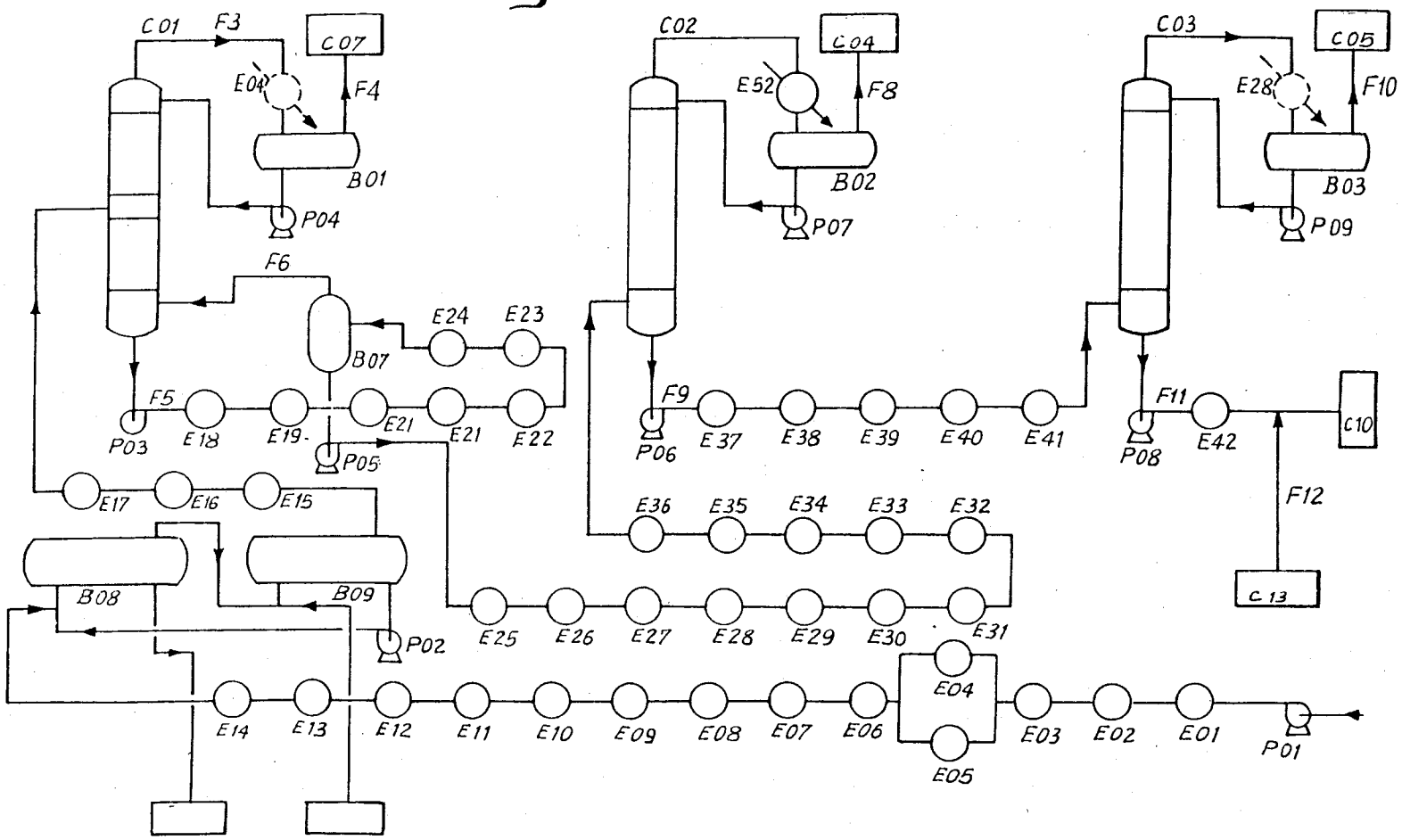
FIGS. 7, 8, 9 and 10 are partial detail diagrams of FIG. 1.
Figure 8:
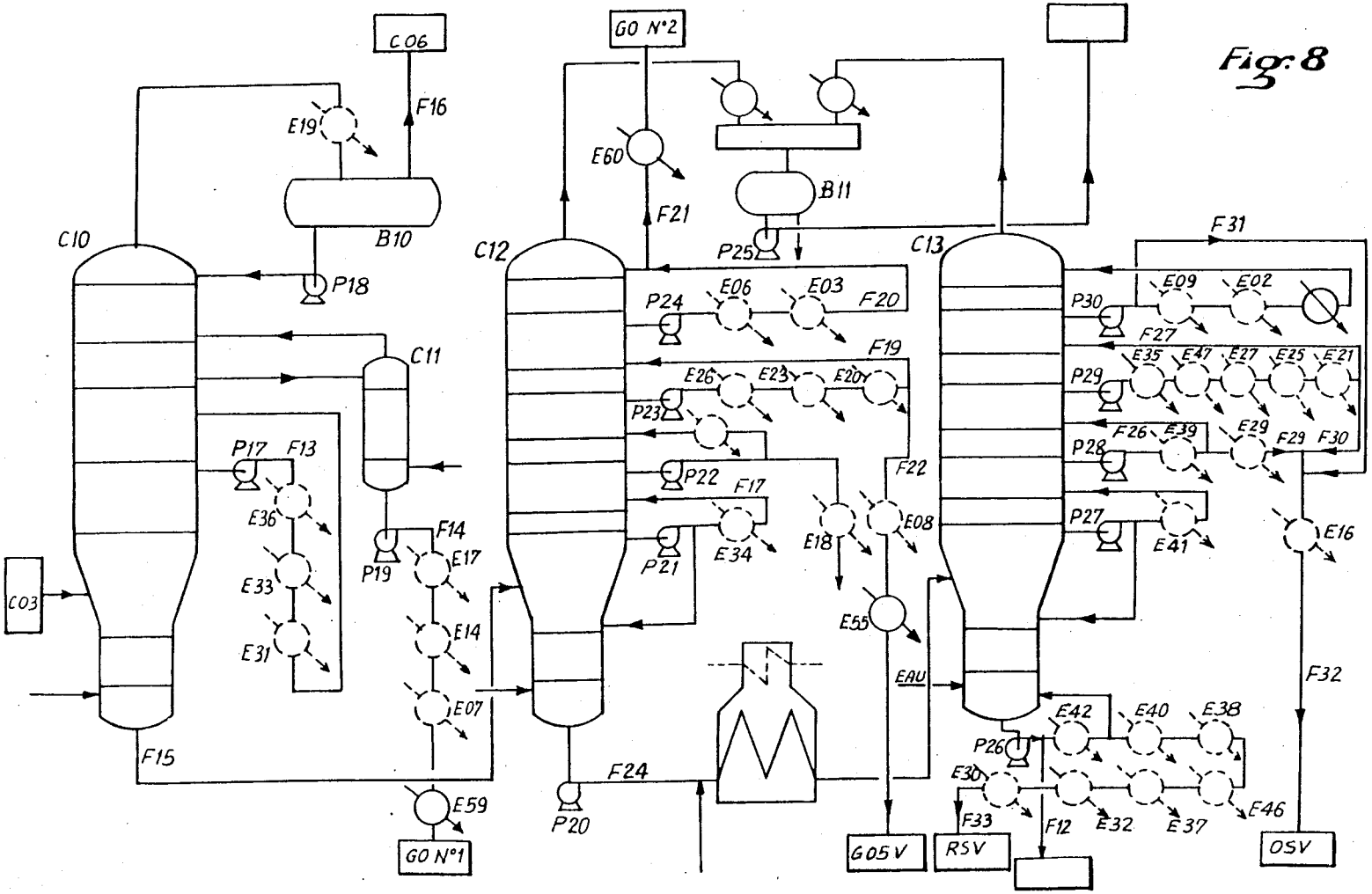
Figure 9:
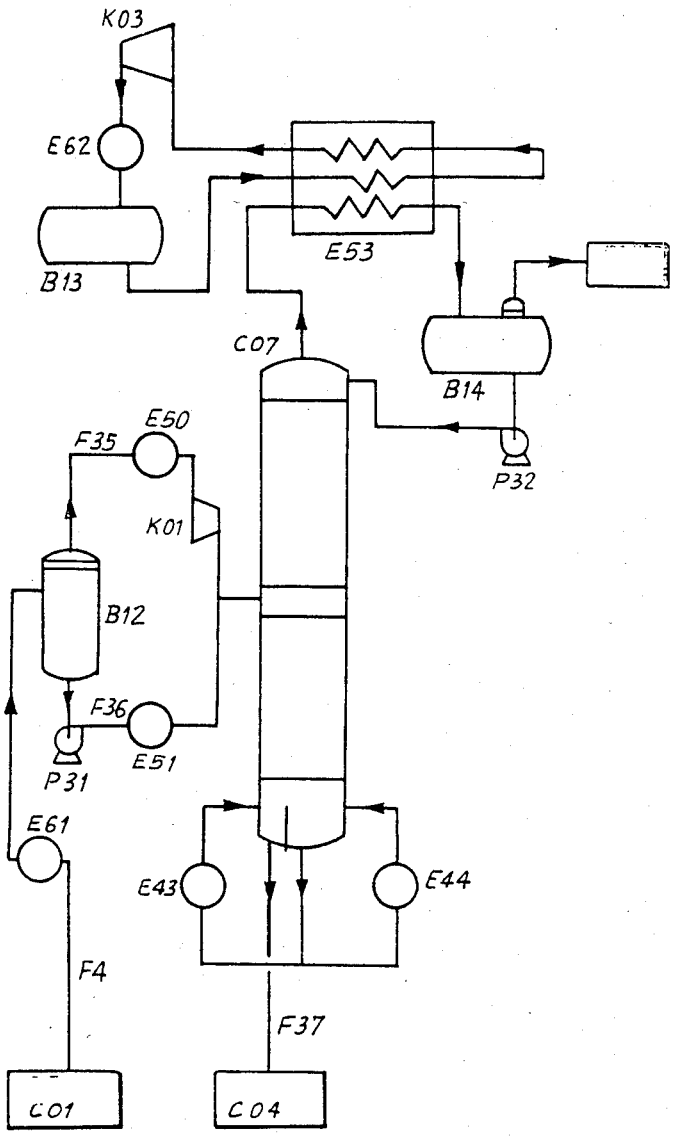
Figure 10:
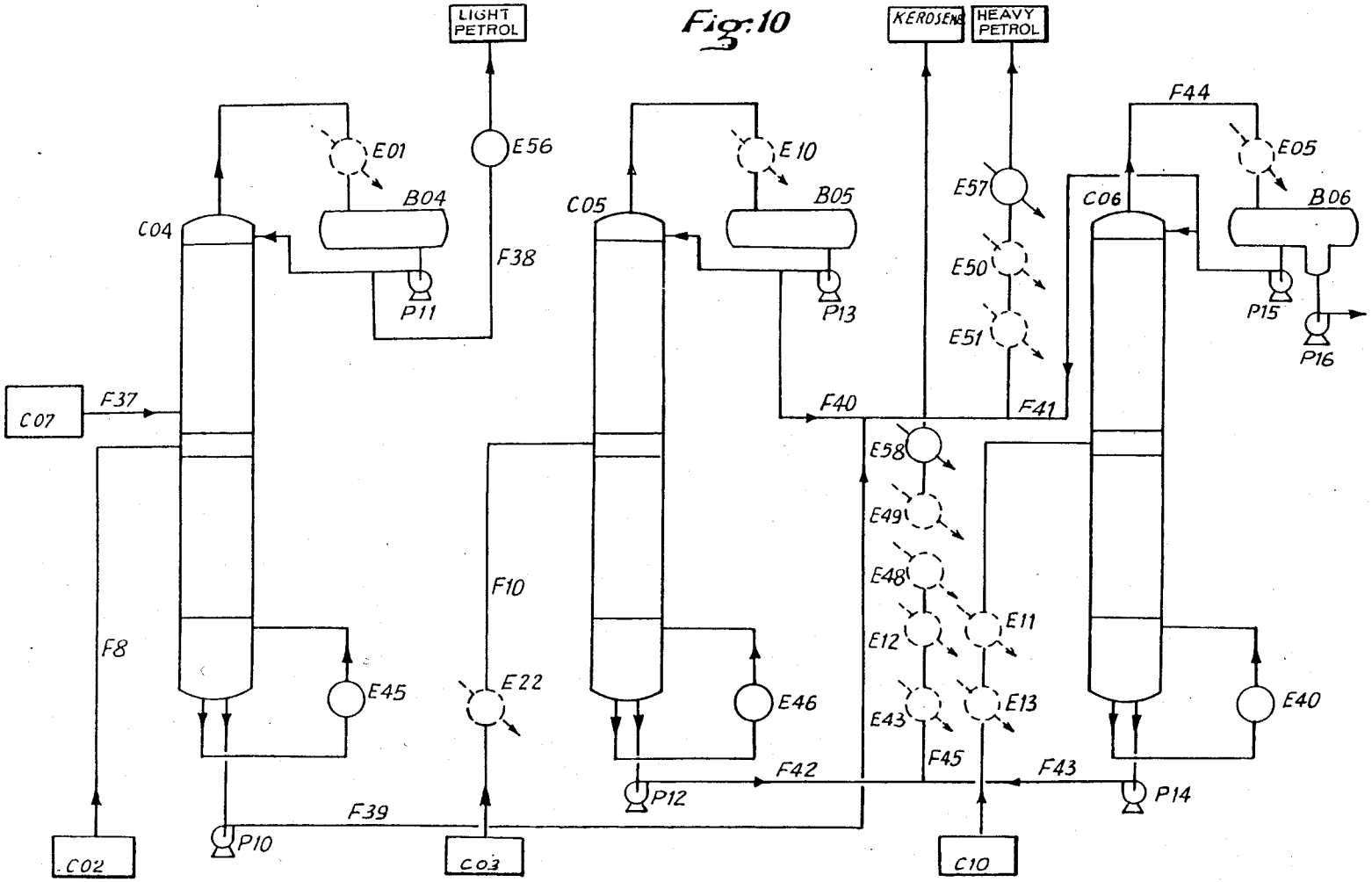

In the variant illustrated in FIG. 6, the column C05 which separates petroleum naphtha from kerosine is fed with the volatile effluents from column C03 and with the residue from column C04.

Other variants could be applied to the process and to the installation in accordance with the invention without thereby departing from its scope, in particular as a function of pre-established production criteria.

What is claimed is:

1. A process for distillation of petroleum of fossil origin or synthetic origin by progressive separations, in which a feed preheated by heat exchange is prefractionated in successive steps in at least one distillation column which operates at a pressure within the range of 1 to 5 atm. abs., wherein said process consists in successively separating increasingly heavy petroleum cuts at the head of a plurality of columns of a first series of distillation columns each fed with a residue from the previous column and in collecting at the bottom of the last column of said series an atmospheric residue which is then processed in a vacuum distillation zone in which provision is made for reheating of the feed in a furnace; wherein the atmospheric residue collected at the bottom of the last column of the first series is fed without any external addition of heat to a first vacuum distillation column, the residue from said column being processed in a second vacuum distillation column after reheating in a furnace; wherein each cut collected at the head of each column of the first series being individually fed to separate columns of a second series of columns, the distillates of which are standard petroleum products; and wherein at least one of the columns of the second series is fed with volatile effluents from two columns of the first series for splitting-up into a plurality of head fractions.

2. A process according to claim 1, wherein the atmospheric residue collected at the bottom of the last column of the first series is reheated directly in a furnace, then processed in a vacuum distillation column.

3. A process according to claim 1, wherein a first column of the second series is a gasoline stabilization column, the volatile effluent from said column being fed to a plant for fractionating light petroleum gases and the residue of said column being mixed with the gasoline cut emerging from the second column of the first series and the mixture is fed to second column of the second series.

4. A process according to claim 3, wherein a second column of the second series is a gasoline fractionating column and the residue from said column consists of a petroleum naphtha which is combined with the volatile fraction of a third column of the second series.

5. A process according to claim 3, wherein a second column of the second series is a gasoline fractionating column and the residue from said column is fed to a third column of the second series.

6. A process according to claim 3, wherein a second column and a third column of the second series are gasoline fractionating columns and the residue from the second column consisting of intermediate gasoline is either withdrawn as a standard petroleum product or fed to the third column together with a cut collected at the head of a third column of the first series for separating the intermediate gasoline from the petroleum naphtha.

7. A process according to claim 3, wherein a second column of the second series is a single gasoline fractionating column which is fed at different levels with the volatile fractions of the second column and of the third column of the first series for separating light gasoline petroleum naphtha and kerosine.

8. A process according to claim 7, wherein a column of the second series which follows the gasoline fractionating column or columns splits the volatile fraction emerging from a column of the first series into petroleum naphtha and kerosine.

9. A process according to claim 8, wherein the last column of the first series is a column provided with a stripper and from which is withdrawn a light atmospheric gas-oil cut, the volatile effluent from said column being fed to a column of the second series for separating petroleum naphtha from kerosine whilst an atmospheric residue is withdrawn from the bottom of the column.

10. A process according to claim 9, wherein one column of the second series which follows the gasoline fractionating column or columns is fed with the volatile cuts issuing from the last column and the last column but one of the first series and a petroleum naphtha is withdrawn at the top of the column and kerosine at the bottom of said column.

11. A process according to claim 10, wherein part of the residue issuing from the last vacuum distillation column is continuously recycled to the feed inlet of one or more atmospheric columns of the first series or of the first vacuum distillation column.

12. A process according to claim 11, wherein the initial feedstock, the residues flowing between the columns of the first series and the effluents flowing between the columns of the second series are preheated by transfer of sensible and latent heat released by circulating effluents produced in the last atmospheric distillation column and in the vacuum distillation columns.

13. A process according to claim 11, wherein the addition of heat for reboiling of columns takes place by transfer of sensible and latent heat released by circulating effluents produced in the last atmospheric distillation column and in the vacuum distillation columns.

14. A process according to claim 13, wherein a fraction of the residue issuing from the last vacuum distillation column is reheated in the furnace and then reintroduced in the last vacuum column.

15. A process for the distillation of petroleum, said process comprising:

(1) processing successively a preheated petroleum feed in at least three atmospheric columns of a first series of columns, wherein each of the said columns is fed by the residue of a foregoing column in the series, and wherein the entrance temperature of each of the said columns increases over a temperature range having as a minimum temperature a temperature at which a head fraction containing light petroleum gases and a part of gasoline is collected, and having as a maximum temperature a temperature at which gas oils are collected at the head fraction;

(2) feeding individually each out collected at the head of each column of the said first series to separate columns of a second series of columns, wherein the distillates of the said colmns of the second series of columns are standard commerical petroleum products;

(3) processing in a vacuum distillation zone the atmospheric residue collected at the bottom of the last column of the first series of columns, said vacuum distillation zone comprising at least one vacuum column, wherein when only one vacuum column is used the residue feeding this unique vacuum column is reheated in a furnace, and when more than one vacuum column is used the residue feeding the last such vacuum column is reheated in a furnace, said furnace being the only source of external heat used in the said process; and (4) wherein part of the residue issuing from the last vacuum distillation column is continuously recycled to the feed inlet of one or atmospheric columns of the first series or of the first vacuum distillation column.

* * * * *